US009920680B1

(12) United States Patent
George et al.

(10) Patent No.: US 9,920,680 B1
(45) Date of Patent: Mar. 20, 2018

(54) COOLING SYSTEM WITH DEBRIS OUTLET FOR A MARINE ENGINE

(71) Applicant: Brunswick Corporation, Lake Forest, IL (US)

(72) Inventors: Trevor George, Eldorado, WI (US); Amir Abou-Zeid, Waupun, WI (US); Daniel Rothe, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 153 days.

(21) Appl. No.: 14/943,486

(22) Filed: Nov. 17, 2015

(51) Int. Cl.

| | |
|---|---|
| ***F01P 3/20*** | (2006.01) |
| ***F02B 39/00*** | (2006.01) |
| ***F01P 11/06*** | (2006.01) |
| ***B63H 20/30*** | (2006.01) |
| *F01P 3/12* | (2006.01) |

(52) U.S. Cl.
CPC ..... *F01P 3/205* (2013.01); *B63H 20/30* (2013.01); *F01P 11/06* (2013.01); *F02B 39/005* (2013.01); *F01P 3/12* (2013.01); *F01P 3/20* (2013.01); *F01P 3/202* (2013.01); *F01P 3/207* (2013.01); *F01P 2011/063* (2013.01)

(58) Field of Classification Search
CPC ..... F10P 3/20; F01P 3/12; F01P 3/202; F01P 3/207
USPC ..... 123/41.31
See application file for complete search history.

(56) References Cited

U.S. PATENT DOCUMENTS

| | | | | |
|---|---|---|---|---|
| 5,049,101 | A * | 9/1991 | Binversie | F01P 3/205 440/88 N |
| 5,133,304 | A * | 7/1992 | Koshimoto | F01P 3/02 123/41.74 |
| 6,551,154 | B1 | 4/2003 | Jaszewski et al. | |
| 8,133,087 | B1 | 3/2012 | Abou Zeid et al. | |
| 8,696,394 | B1 | 4/2014 | Langenfeld et al. | |
| 2009/0130928 | A1 | 5/2009 | Taylor et al. | |
| 2011/0253076 | A1* | 10/2011 | Mikame | F01P 3/202 123/41.31 |
| 2013/0315712 | A1* | 11/2013 | Bogner | F01D 25/14 415/116 |
| 2014/0026829 | A1* | 1/2014 | Tobergte | F01P 3/02 123/41.1 |

* cited by examiner

*Primary Examiner* — Jacob Amick
*Assistant Examiner* — Charles Brauch
(74) *Attorney, Agent, or Firm* — Andrus Intellectual Property Law, LLP

(57) ABSTRACT

A cooling system for a marine engine has a cooling jacket disposed in thermal communication with a heat-emitting portion of the marine engine. The cooling jacket has a water inlet, and a water outlet on an upper portion of the cooling jacket. A pump is connected in fluid communication with the water inlet and/or the water outlet that causes water to flow through the cooling jacket in order to cool the heat-emitting portion, wherein a flow velocity of water in the cooling jacket is low such that debris sinks to a lower portion of the cooling jacket. A debris outlet is in the lower portion of the cooling jacket that expels the debris from the cooling jacket.

20 Claims, 4 Drawing Sheets

COOLING SYSTEM WITH DEBRIS OUTLET FOR A MARINE ENGINE

FIELD

The present invention generally relates to a cooling system for a marine propulsion device that intakes water from a water body surrounding the propulsion device and circulates it in order to cool one or more portions of the propulsion device, such as portions of the marine engine therein. More particularly, the present invention relates to such a cooling system configured to remove debris from an inlet opening to a portion of the cooling system to avoid developing a clog in the system.

BACKGROUND

The following U.S. patents and patent applications are hereby incorporated by reference in their entirety.

U.S. Pat. No. 8,133,087 discloses an outboard motor cooling water distribution system that directs water from the water jacket of an engine through a container in which a conduit has a first inlet opening that is configured to cause a water stream to entrain debris from a region near a drain opening of the container and prevent the debris from building up in the vicinity of the drain opening. Debris which is heavier than the water is drawn upwardly through the first inlet opening of the conduit and conducted away from the container. Debris which is lighter than water is entrained in a second water flow and conducted through a second inlet opening of the conduit so that it can be drawn into the conduit and conducted away from the container. The creation of the first water flow maintains the area around the drain opening in a clean condition as a result of the velocity and direction of the water flow caused by the position and size of the first inlet opening of the conduit. The primary function of the present invention is to prevent a buildup of debris in the area around the drain opening and the potential blockage of the drain opening that could result from that type of buildup.

U.S. Pat. No. 6,551,154 discloses a tell-tale system for an outboard motor in which the tell-tale fluid conduit is connectable to an external water source, such as a water hose, and is extendable away from the cowl of the outboard motor in order to facilitate its use during a flushing operation. When not being used in the flushing procedure, the connector of the fluid conduit is snapped into position in connection with the cowl to maintain its position when used as a tell-tale port.

U.S. Pat. No. 8,696,394 discloses a marine propulsion system comprising an internal combustion engine, a cooling circuit carrying cooling fluid that cools the internal combustion engine, a sump holding oil that drains from the internal combustion engine, and a heat exchanger receiving the cooling fluid. The oil that drains from the internal combustion engine to the sump passes through and is cooled by the heat exchanger.

U. S. Patent Application No. 2009/0130928 discloses a cooling system for a marine engine having a turbocharger that provides a flow of coolant through heat emitting objects prior to flowing through a coolant jacket of the turbocharger itself. This avoids the potentially disadvantageous circumstance of directing cold water directly from a body of water through the cooling jacket of the turbocharger. Both open loop and closed loop versions of the invention are illustrated and described.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one embodiment, a cooling system for a marine engine has a cooling jacket disposed in thermal communication with a heat-emitting portion of the marine engine. The cooling jacket has a water inlet, and a water outlet on an upper portion of the cooling jacket. A pump is connected in fluid communication with the water inlet and/or the water outlet that causes water to flow through the cooling jacket in order to cool the heat-emitting portion, wherein a flow velocity of water in the cooling jacket is low such that debris sinks to a lower portion of the cooling jacket. A debris outlet is in the lower portion of the cooling jacket that expels the debris from the cooling jacket.

An embodiment of a marine engine has a supercharger and a cooling jacket disposed in thermal communication with the supercharger. The cooling jacket has a water inlet on a lower portion of the cooling jacket, a water outlet on an upper portion of the cooling jacket, and a debris outlet in the lower portion of the cooling jacket that expels the debris from the cooling jacket. A pump causes water to flow through the cooling jacket in order to cool the supercharger, wherein a flow velocity of water in the cooling jacket is low such that debris sinks to the lower portion of the cooling jacket.

Various other features, objects and advantages of the invention will be made apparent from the following description taken together with the drawings.

BRIEF DESCRIPTION OF THE DRAWINGS

The present disclosure is described with reference to the following Figures. The same numbers are used throughout the Figures to reference like features and like components.

DETAILED DESCRIPTION

In the present disclosure, certain terms have been used for brevity, clarity, and understanding. No unnecessary limitations are to be inferred therefrom beyond the requirement of the prior art because such terms are used for descriptive purposes and are intended to be broadly construed.

Figure 1:
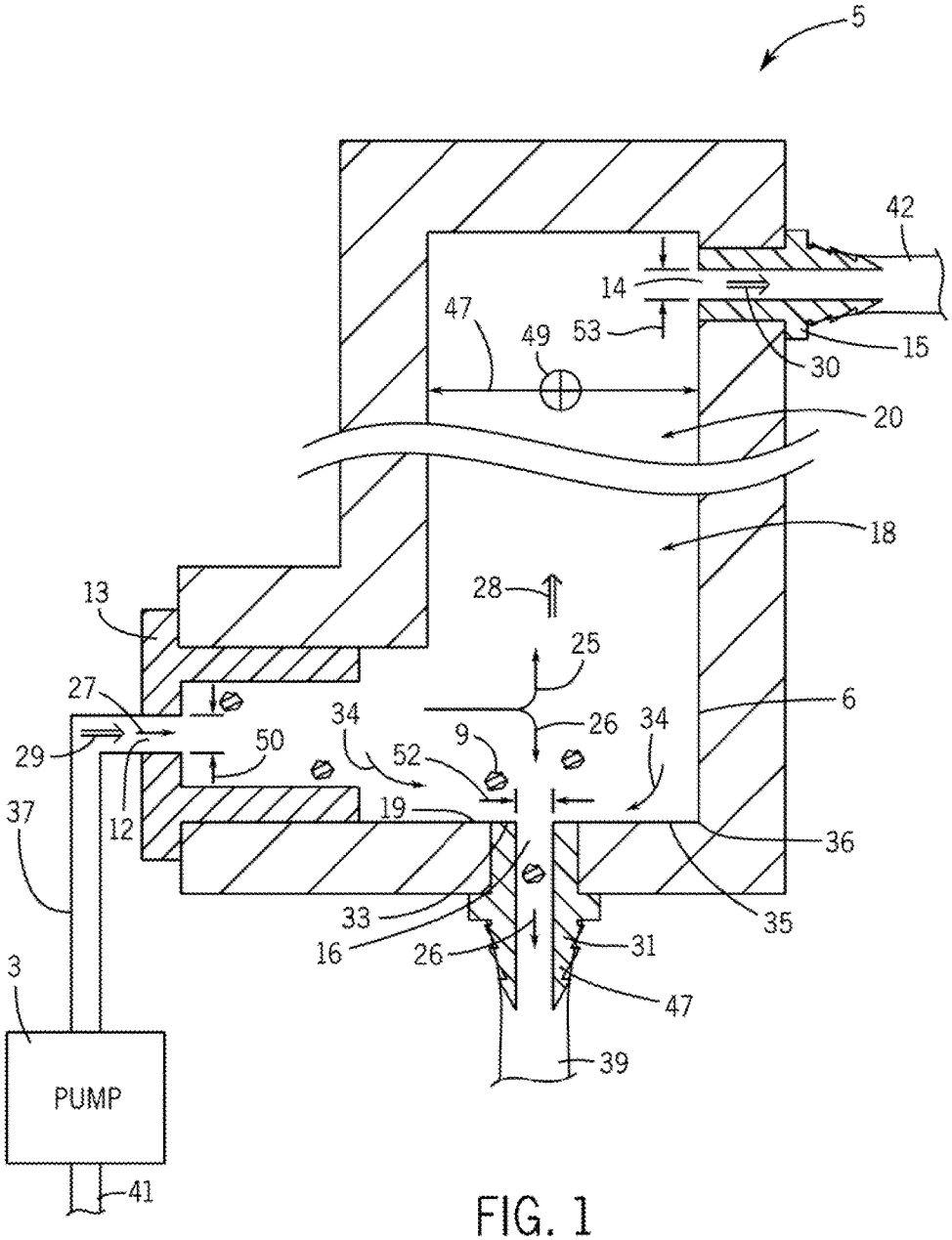
FIG. 1 depicts one embodiment of a cooling system for a marine engine.
Figure 2:
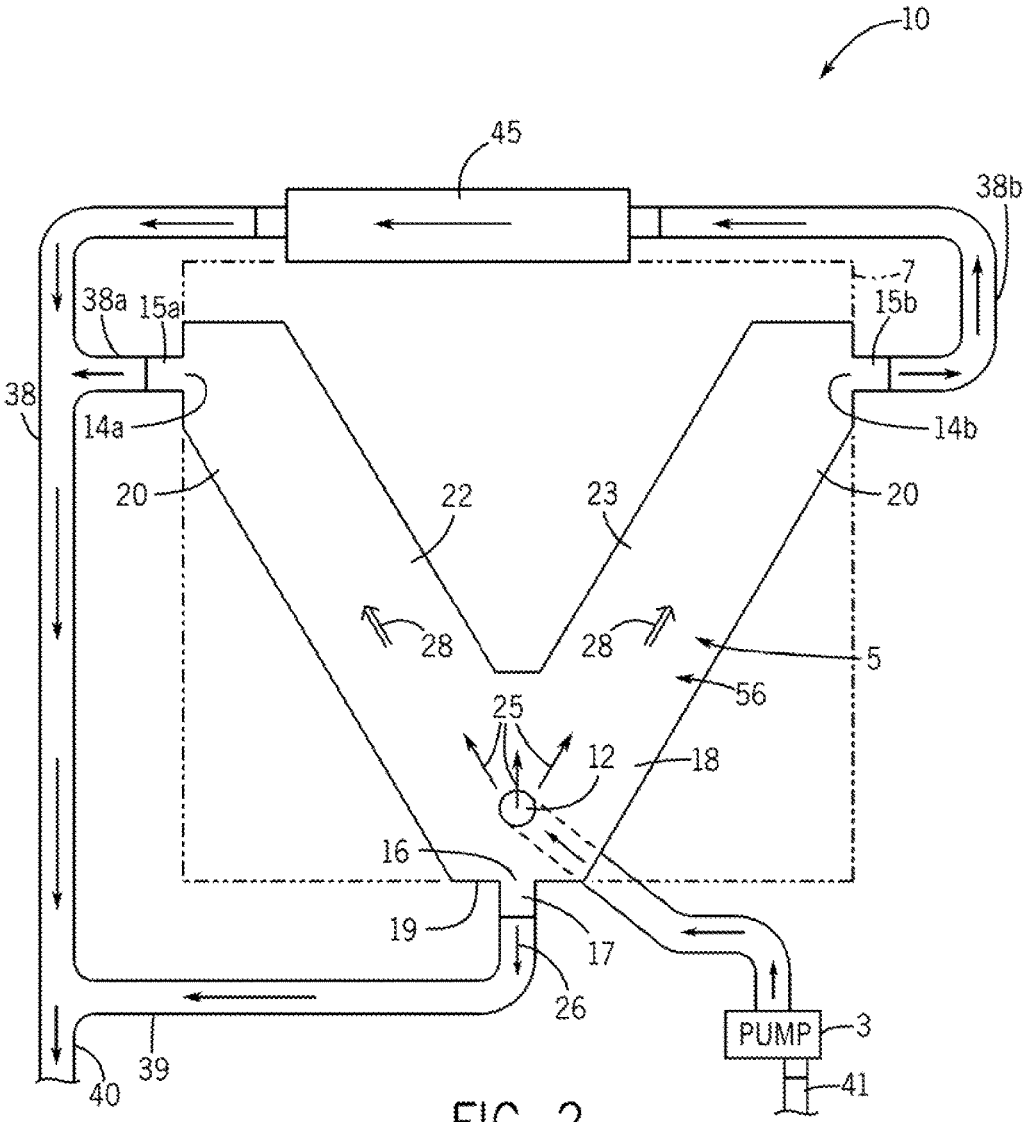
FIG. 2 depicts one embodiment of a cooling jacket according to the present disclosure.

FIGS. 1 and 2 show embodiments of a cooling system 10 for a marine engine including a cooling jacket 5 having at least one water inlet 12 and at least one water outlet 14. In the embodiment of FIG. 1, which provides a cross-sectional view of a cooling jacket 5, the system further includes a pump 3 connected in fluid communication with the water inlet 12 that causes water to flow through the cooling jacket 5. The cooling jacket is in thermal communication with a heat-emitting portion 7 of the marine engine, and thus the water flowing through the cooling jacket 5 cools the heat emitting portion 7. Water is sucked in through intake 41, and is propelled through the cooling system 10 via one or more pumps 3. As shown in FIG. 1, the pump 3 is in fluid communication with the water inlet 12 to cooling jacket 5 and forces the water through the water input hose 37, into the cooling jacket 5, and out of the water outlet 14 of the cooling jacket 5. In other embodiments, the pump 3, or an additional pump, may be connected at an output end 42 of the water outlet 14 of the water jacket 5.

The water slows down significantly when it reaches the cooling jacket 5 from the water inlet 12 because the diameter 50, 53 and/or cross-sectional area of both the water inlet 12 and the water outlet 14 are significantly smaller than a diameter 52 and/or cross-sectional area of the cooling jacket 5. To provide one exemplary embodiment, the diameter 50 of the water inlet 12 and the diameter 53 of the water outlet 14 may each be approximately 4.75 mm. However, in other embodiments the diameters 50 and 53 may be larger or smaller, and may be different from one another. The cross-sectional area of the cooling jacket 5 (such as the width 47 multiplied by the depth 49 in the embodiment of FIG. 1) may be in the range of 2 to 3 square inches, for example. In such an embodiment, the diameter 52 of the debris outlet 16 may be approximately 3 mm; however, the debris outlet size may be larger or smaller depending on the largest debris particle 9 expected to enter the cooling system 10.

Accordingly, a flow velocity 28 in the cooling jacket 5 is less than a flow velocity 29 through the inlet 12. Likewise, the flow velocity 28 in the cooling jacket 5 is less than a flow velocity 30 through the outlet 14. The flow velocity 28 inside the water jacket is slow enough such that the water flow cannot overcome the force of gravity on debris 9 in the water, and thus debris, especially heavy debris, falls to the bottom 19 of the cooling jacket 5. Through their experimentation and research, the inventors recognized that the flow velocity 28 inside the cooling jacket 5 was insufficient to carry certain debris 9, such as heavy debris that sinks in water, and recognized that the collection of debris 9 at the bottom 19 of the cooling jacket 5 could eventually lead to a blockage of the inlet 12. Thus, through experimentation and research, the inventors developed a debris outlet 16 in the lower portion 6 of the cooling jacket 5 sized to expel the debris 9 out of the cooling jacket 5.

As one of skill in the art will understand in light of the disclosure, cooling systems for marine engines typically involve a cooling jacket, sometimes called a water jacket, through which cooling water flows in order to cool various heat emitting portions 7 of the marine engine. The cooling water is taken from the body of water in which a marine propulsion device containing the marine engine 54 (FIG. 3) is operating. The water surrounding the marine propulsion device often contains debris, including buoyant debris, such as aquatic grasses, hay and leaves, and heavy debris, such as sand and ground shells. Such debris often gets sucked into the intake 41 of the cooling system 10 and circulated through the cooling system. Some existing cooling systems utilize filtering devices that strain the intake water, and related techniques to avoid the intake of debris through the cooling system 10. However, some types and sizes of debris still make it into the system. Furthermore, such straining filters often become clogged, causing maintenance issues for users. Thus, usage of such straining filters may be undesirable. Accordingly, the present inventors developed the presently disclosed system and apparatus that offers a solution to the problem of debris collection obstructing the inlet 12 of the cooling jacket 5 by adding a debris outlet 16 sized appropriately such that the opening is large enough to allow debris to be expelled, while minimizing the volume of water lost from the cooling system through the debris outlet 16. In one embodiment, the debris outlet 16 has a diameter 52 that is at least as large as the smallest water inlet in the system leading up to the cooling jacket 5. For example, if a filter is employed, such as at the inlet 41, the diameter 52 may be at least as large as the largest pore of the filter. In various embodiments, the diameter 52 of the debris outlet 16 is sized based on the largest debris expected to enter the cooling system 10. To provide just one example, the diameter 52 may be between 2 mm and 3 mm.

Through their experimentation and research, the present inventors have recognized that certain critical velocities are required in order to propel debris of certain sizes and weights vertically upward through the cooling system 10. The inventors conducted research based on stones of specified sizes and weights in order to calculate and test the critical velocity required to lift the stone through the cooling system 10. The following table reports the results:

| Size (radius) mm | Bouyancy force in water (N) | mass of stone ball (kg) | weight of stone ball (N) | Weight in water (N) | Critical Velocity (m/s) |
|---|---|---|---|---|---|
| 1 | 0.00004 | 0.00001 | 0.00012 | 0.00007 | 0.34 |
| 2 | 0.00033 | 0.00009 | 0.00092 | 0.00059 | 0.49 |
| 3 | 0.00111 | 0.00032 | 0.00311 | 0.00200 | 0.59 |
| 4 | 0.00263 | 0.00075 | 0.00736 | 0.00474 | 0.69 |
| 5 | 0.00513 | 0.00147 | 0.01438 | 0.00925 | 0.77 |
| 6 | 0.00887 | 0.00253 | 0.02485 | 0.01598 | 0.84 |

Accordingly, for stones having an approximate radius of 1 mm and weighing approximately 0.07 millinewtons (mN) in water, the critical velocity is 0.34 meters per second (m/s). For a stone particle having an approximate radius of 3 mm and weighing approximately 2 mN in water, the critical velocity required to lift the stone vertically through the cooling system 10 is 0.59 m/s. For a stone having a 6 mm radius and a weight in water of approximately 15.98 mN, the critical velocity of water to lift the stone upwards is 0.84 m/s. The flow velocity 28 in the cooling jacket 5 may be below one or all of these exemplary critical velocities, and thus particles having a critical velocity above the flow velocity 28 in the cooling jacket will sink to the bottom 19 of the cooling jacket 5.

Moreover, the present inventors recognized that the location of the debris outlet 16 can be optimized such that a flow pattern of water in the cooling jacket 5 does not allow the collection of debris 9 at the bottom 19 of the cooling jacket 5, and thus that nearly all debris 9 is forced out of the cooling jacket 5. For example, the water jacket 5 may be configured such that a flow direction 26 out of the debris outlet 16 is opposite, or approximately opposite, of a flow direction 25 of water in the cooling jacket 5. Thus, the water enters through the water inlet 12 in flow direction 27 and then splits into flow direction 25 through the water jacket 5 and flow direction 26 through the debris outlet 16. A portion of the water hits the jacket sidewall 6 and is diverted upward through the water jacket 5 or downward through the debris outlet 16. This sharp directional changes creates currents 34 in the lower portion 18 of the cooling jacket 5 such that significant buildup of debris particles 9 is not permitted anywhere along the bottom 19 of the cooling jacket 5.

In other embodiments, the debris outlet 16 may be at any location in the lower portion 18 of the cooling jacket 5. For example, the debris outlet 16 may be on a rear wall or front wall portion of the cooling jacket 5. In the context of FIG.

1, for example, the debris outlet 16 may extend out a back side or front face of the cooling jacket 5 (not shown). In each such embodiment, including the embodiment depicted in FIG. 1, the direction 26 of water flow out of the debris outlet 16 extends perpendicularly to the direction 27 of water flow in the water inlet 12. In still other embodiments, the debris outlet 16 may be on a lower portion of the jacket sidewall 6, preferably close to the bottom 19 of the cooling jacket 5 so that debris particles 9 are not permitted to buildup on the interior surface 35 of the bottom 19 of the cooling jacket 35. In still another embodiment, the debris outlet 16 may be at the bottom corner 36 where the bottom 19 of the cooling jacket 5 meets the jacket sidewall 6. The water inlet 12 may be at any location on the cooling jacket, and in various embodiments, could be located at or closer to a vertical middle region of the cooling jacket 5.

Each of the water inlet 12, water outlet 14, and debris outlet 16 may have a fitting therein to guide the flow appropriately. For example, the water inlet 12 may have a water inlet fitting 13 therein. The water inlet fitting 13 may be configured to provide a water inlet 12 with a diameter 50. As shown in FIG. 1, the water inlet fitting 13 may be configured to widen the inlet passage once inside the cooling jacket 5. Additionally, the water inlet fitting 13 may be configured to connect to a water input hose 37. The water input hose 37 may bring input water from pump 3, as shown in FIG. 1. Alternatively, the water input hose 37 may bring water from another portion of the cooling system, such as another cooling jacket element, or directly from the water source surrounding the marine propulsion device.

The water outlet 14 may be provided with a fitting 15, which provides a connection point to a hose at output end 42 of the cooling jacket 5 and provides an output path for water from the cooling jacket 5. Likewise, the debris outlet 16 may be provided with fitting 17 that connects to debris output hose 39. Debris output hose 39 carries the debris 9 and the water flushing the debris 9 from the cooling jacket 5 to an output end of the cooling system 10 that directs the water and debris back into the water source and outside of the marine propulsion device. In certain embodiments, the debris output hose 39 may be oriented in any direction or path required or optimal for carrying the debris out of the system, including in a vertical direction, assuming that the flow velocity inside the relatively narrow debris output hose 39 will be high enough to carry the heaviest debris present in the system. In one embodiment, a top portion 33 of the debris outlet fitting 17, and thus of the debris outlet 16, is flush with the interior surface 35 at the bottom 19 of the cooling jacket 5. Such a flush surface prevents a buildup of debris particle 9 around the inlet of the debris outlet 16. In another embodiment, the top portion 33 of the debris outlet 16 is raised slightly above the interior surface 35 at the bottom 19 of the cooling jacket 5, which also prevents buildup of debris particles 9 that could block the flow of debris out the debris outlet 16. Through their experimentation and research, the present inventors have recognized that certain embodiments having a debris outlet 16 with a top surface 33 below the interior surface 35 at the bottom 19 of the cooling jacket 5 may cause debris particles 19 to buildup along the top portion 33, which could inhibit the exit of debris particles 9 out of the debris outlet 16, which would eventually build up and block the water inlet 12.

The cooling jacket 5 may take on any shape needed to cool one or more heat-emitting portions 7 of a marine engine 54. In the example of FIG. 1, the main portion of the cooling jacket 5 is approximately rectangular in shape. In other embodiments, the cooling jacket may be cylindrical, for example, or a curved shape that bends around one or more heat-emitting portions of a marine engine 54. In the example provided at FIGS. 2 and 3, the cooling jacket is V-shaped, and more particularly an arched V-shape, having a first leg 22 and a second leg 23 extending upward and at an angle from the bottom 19 of the cooling jacket 5. Each leg 22, 23 of the cooling jacket 5 has a separate water outlet 14*a*, 14*b*. Specifically, the first leg 22 has a first water outlet 14*a* provided with a first water outlet fitting 15*a* that connects to a first water output hose 38*a*. Likewise, the second leg 23 of the cooling jacket 5 has a second water outlet 14*b* with a second water outlet fitting 15*b* that connects to a second water output hose 38*b*. In the embodiment of FIG. 2, the second water output hose 38*b* directs water to the end plate jacket 45, which is another element in the cooling system 10 that is in thermal connection with the heat emitting portion 7. In various embodiments, the water output hose 38, including the first water output hose 38*a* and/or the second water output hose 38*b*, may connect to any of various other elements in the cooling system 10. In still other embodiments, the water output hose(s) 38 may or may not connect to any other cooling element and may lead directly to a system outlet 40 that expels water back into the water body surrounding the marine propulsion device.

Figure 3:
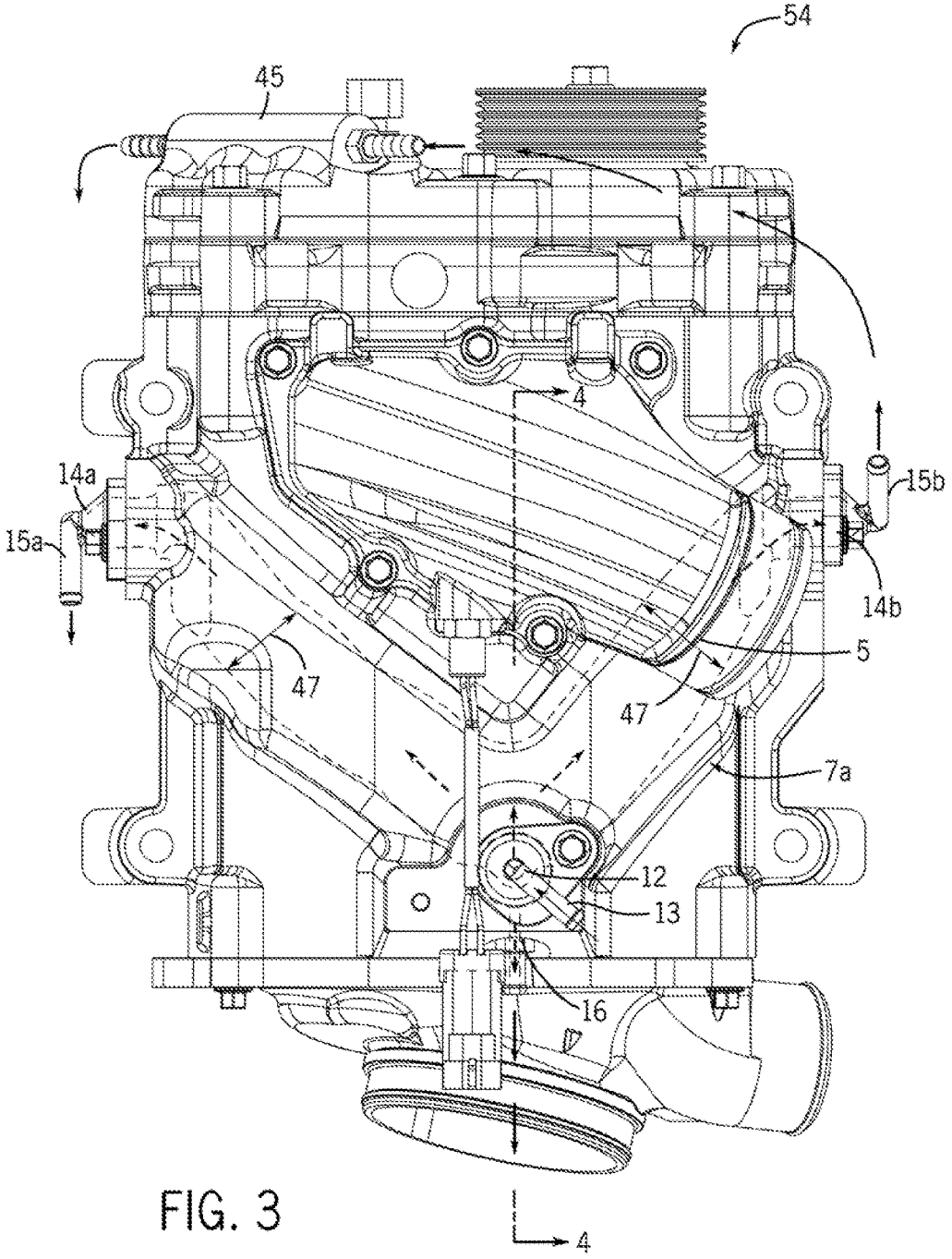
FIG. 3 depicts a marine engine incorporating one embodiment of a cooling system according to the present disclosure.
Figure 4:
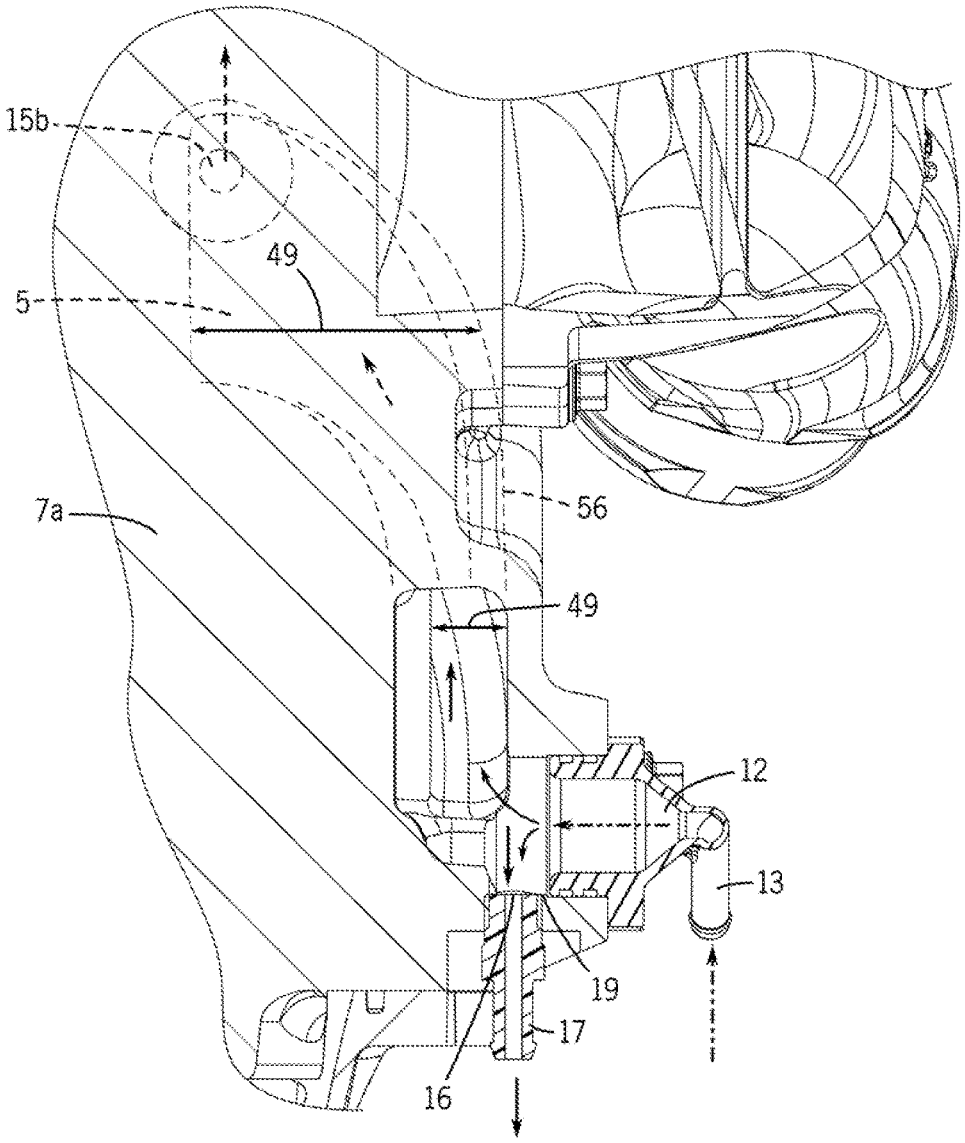
FIG. 4 depicts a cross-sectional view of the marine engine incorporating the embodiment of the cooling system shown in FIG. 3.

The cooling jacket 5 may be configured in any of various geometrical shapes in order to optimize cooling with the heat emitting portion 7. FIGS. 3 and 4 depict an exemplary arrangement of cooling jacket 5 on a supercharger 7*a* of marine engine 54. The V-shaped cooling jacket 5 has an arched shape that curves around a portion of the supercharger 7*a* in order to maximize heat absorption from the supercharger 7 while not interfering with surrounding elements or the overall layout of the marine engine 54. The water inlet 12 is provided on the lower portion of the cooling jacket 5 and in a front face 56 of the cooling jacket 5. As water enters the water inlet 12, it is primarily diverted upward along direction arrows 25 through the cooling jacket 5. A smaller portion of the water is diverted downward through the debris outlet 16 and carries with it debris particles that enter the water inlet 12. The cooling water then travels up each leg 22, 23 of the cooling jacket 5 at flow velocity 28 and exits the water outlets 14*a*, 14*b*. In one exemplary embodiment of the V-shaped cooling jacket 5, each leg 22, 23 may have a width 47 of approximately 25 mm, which may vary along the length of each leg. To provide further example, each leg 22, 23 may have a length of approximately 150 mm. The depth of each leg 22, 23 in the embodiment of FIGS. 3 and 4 varies significantly along the length of each leg, which may range between 13 mm at a shallow point and 30 mm at a deeper point.

The cooling jacket 5 may be comprised of any material or materials that allow thermal communication with the heat-emitting portion 7 so that heat can be transferred from the heat-emitting portion 7 to the water in the cooling jacket 5. For example, the walls of the cooling jacket may be comprised of an aluminum material.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A cooling system for a marine engine comprising:

a cooling jacket disposed in thermal communication with a heat-emitting portion of the marine engine;

a water inlet on the cooling jacket;

a water outlet on an upper portion of the cooling jacket;

a pump connected in fluid communication with the water inlet and/or the water outlet that causes water to flow through the cooling jacket in order to cool the heat-emitting portion;

wherein a flow velocity of water in the cooling jacket is low such that debris sinks to a lower portion of the cooling jacket; and a debris outlet in the lower portion of the cooling jacket that expels the debris from the cooling jacket while water flows into the cooling jacket through the water inlet and out of the cooling jacket through the water outlet.

2. The cooling system of claim 1, wherein the cooling jacket has a larger cross-sectional area than a cross-sectional area of each of the water inlet and water outlet, such that flow velocity in the cooling jacket is less than a flow velocity in the water inlet and a flow velocity in the water outlet.

3. The cooling system of claim 1, wherein a flow direction of water out the debris outlet is perpendicular to a flow direction of water in the water inlet.

4. The cooling system of claim 1, wherein the debris outlet extends downward from a bottom of the cooling jacket.

5. The cooling system of claim 4, wherein a top portion of the debris outlet is flush with an interior surface of the bottom of the cooling jacket.

6. The cooling system of claim 4, wherein a direction of water flow out the debris outlet is in an opposite direction from a direction of water flow in the cooling jacket.

7. The cooling system of claim 1, wherein the heat-emitting portion is a supercharger.

8. The cooling system of claim 7, wherein the cooling jacket is v-shaped.

9. The cooling system of claim 1, further comprising a second water outlet on the upper portion of the cooling jacket.

10. The cooling system of claim 1, wherein the debris outlet has a diameter between 2 mm and 4 mm.

11. The cooling system of claim 10, wherein the flow velocity of water in the cooling jacket is less than or equal to 0.59 meters per second.

12. A marine engine comprising:

a supercharger;

a cooling jacket disposed in thermal communication with the supercharger;

a water inlet on a lower portion of the cooling jacket;

a water outlet on an upper portion of the cooling jacket;

a pump that causes water to flow through the cooling jacket in order to cool the supercharger;

wherein a flow velocity of water in the cooling jacket is low such that debris sinks to a bottom of the cooling jacket; and a debris outlet in the lower portion of the cooling jacket that expels the debris from the cooling jacket while water flows into the cooling jacket through the water inlet and out of the cooling jacket through the water outlet.

13. The marine engine of claim 12, wherein the cooling jacket has a larger cross-sectional area than a cross-sectional area of each of the water inlet and water outlet, such that flow velocity in the cooling jacket is less than a flow velocity in the water inlet and the water outlet.

14. The marine engine of claim 12, wherein a flow direction of water out the debris outlet is perpendicular to a flow direction of water in the water inlet.

15. The marine engine of claim 12, wherein the debris outlet extends downward from the bottom of the cooling jacket.

16. The marine engine of claim 15, wherein a top portion of the debris outlet is flush with an interior surface of the bottom of the cooling jacket.

17. The marine engine of claim 15, wherein a direction water flow out the debris outlet is opposite a direction of water flow in the cooling jacket.

18. The marine engine of claim 12, wherein the cooling jacket is v-shaped and the water outlet extends from the upper portion of one leg of the v-shaped cooling jacket, and further comprising a second water outlet that extends from the upper portion of a second leg of the v-shaped cooling jacket.

19. The marine engine of claim 18, wherein the debris outlet extends downward from the bottom surface of the cooling jacket.

20. The marine engine of claim 12, wherein the debris outlet has a diameter between 2 mm and 4 mm.

* * * * *